US012467719B2

(12) United States Patent
Nielsen

(10) Patent No.: US 12,467,719 B2
(45) Date of Patent: Nov. 11, 2025

(54) COMPACT DOVETAIL PISTOL SIGHT ADJUSTMENT TOOL

(71) Applicant: Kristian Nielsen, Chicago, IL (US)

(72) Inventor: Kristian Nielsen, Chicago, IL (US)

(73) Assignee: TITAN PRODUCT DEVELOPMENT, LLC, Chicago, IL (US)

( * ) Notice: Subject to any disclaimer, the term of this patent is extended or adjusted under 35 U.S.C. 154(b) by 0 days.

(21) Appl. No.: 18/899,861

(22) Filed: Sep. 27, 2024

(65) Prior Publication Data

US 2025/0102276 A1 Mar. 27, 2025

Related U.S. Application Data

(60) Provisional application No. 63/540,724, filed on Sep. 27, 2023.

(51) Int. Cl.
*F41G 1/54* (2006.01)

(52) U.S. Cl.
CPC ..... *F41G 1/545* (2013.01)

(58) Field of Classification Search
CPC ..... F41G 1/545
See application file for complete search history.

(56) References Cited

U.S. PATENT DOCUMENTS

| | | | | |
|---|---|---|---|---|
| 2,599,839 | A * | 6/1952 | Keifer, Jr. | F41G 1/26 254/98 |
| 4,669,193 | A * | 6/1987 | Moore | F41G 1/545 33/613 |
| D335,805 | S * | 5/1993 | Ransom | D8/51 |
| 8,397,422 | B2 * | 3/2013 | Bietsch | F41G 1/545 33/274 |
| 8,707,609 | B2 * | 4/2014 | Fisher | F41C 27/00 33/274 |
| 8,910,413 | B2 * | 12/2014 | Hillwig, Jr. | F41G 1/545 42/143 |
| 9,127,899 | B2 * | 9/2015 | Shipman | F41G 1/545 |
| 9,464,870 | B2 * | 10/2016 | Gomez | F41G 1/545 |
| 9,784,535 | B1 * | 10/2017 | Cheng | F41G 1/545 |
| 9,869,529 | B2 * | 1/2018 | Gomez | F41G 1/545 |
| 10,955,219 | B1 * | 3/2021 | Morris | F41G 1/545 |
| 11,199,378 | B2 * | 12/2021 | LoRocco | F41G 1/545 |
| 11,226,174 | B1 * | 1/2022 | Chen | F41G 1/545 |
| 12,018,916 | B1 * | 6/2024 | Morris | F41G 1/545 |
| 12,345,485 | B2 * | 7/2025 | Dunn | F41A 11/00 |
| 12,405,084 | B2 * | 9/2025 | Pastusek | F41G 1/22 |
| 2015/0135500 | A1 * | 5/2015 | Jorge Gomez | F41G 1/545 81/484 |
| 2021/0364253 | A1 * | 11/2021 | Chen | F41G 1/545 |

* cited by examiner

*Primary Examiner* — Michelle Clement
(74) *Attorney, Agent, or Firm* — Justin Lampel

(57) ABSTRACT

A compact dovetail pistol sight adjustment tool is provided. The compact dovetail pistol sight adjustment tool has a main housing, a folding leg, a folding sight pusher, an adjustable ratchet and a hex drive. The compact dovetail pistol sight adjustment tool can be transformed into a collapsed orientation for easy storage and transportation.

7 Claims, 2 Drawing Sheets

COMPACT DOVETAIL PISTOL SIGHT ADJUSTMENT TOOL

CROSS REFERENCE TO RELATED APPLICATIONS

The following application is a based on and claims the priority benefit of U.S. provisional application Ser. No.: 63/540,724 filed Sep. 27, 2023 currently; the entire content of which is incorporated by reference.

BACKGROUND OF THE INVENTION

A compact dovetail pistol sight adjustment tool is provided. The compact dovetail pistol sight adjustment tool has a main housing, a folding leg, a folding sight pusher, an adjustable ratchet and a hex drive. The compact dovetail pistol sight adjustment tool can be transformed into a collapsed orientation for easy storage and transportation.

Tools for working on rifles are known. For example, U.S. Pat. No. 10,724,819 to Strombeck discloses systems, and methods for the maintenance, repair, modification, cleaning, disassembly, and reassembly of firearms and firearm components. Particular embodiments include tools to aid in the removal and insertion of an extractor pin from the bolt assembly of an AR-15 or M-16 rifle. Preferred embodiments are directed to bolt assemblies for 0.223 and 0.308 imperial caliber firearms, as well as 5.56 and 7.62 metric caliber firearms. The tools include a housing with a channel to receive the bolt, a channel to insert a locking rod to orient and secure the bolt in the housing, a channel for inserting a removal rod to remove the extractor pin from the bolt or an inserting rod to insert the extractor pin into the bolt.

Further, U.S. Pat. No. 8,695,477 to Esch discloses an assembly tool for a bolt catch on a firearm having a bolt that slides between a latched position and an unlatched position, the bolt held in the latched position by a bolt catch mechanism that includes a catch-release actuator pivotally mounted on the rifle to provide for latching and unlatching of the bolt by a user, the assembly including a lever having an L-shaped body that comprises a first leg and a second leg that is formed at substantially a right angle to the first leg, the first leg having a free end on which is formed a mounting member; and a clamp member structured to attach to the mounting member on the lever to enable clamping of the lever to the catch-release actuator in a manner that does not require disassembly of the firearm or disassembly or removal of the catch-release actuator from the firearm.

Still further, U.S. Pat. No. 9,279,634 to Shipman discloses a firearm bolt cleaning tool having a tool core defining a plurality of scraper surfaces. The scraper surfaces include a first gas ring scraper surface, a first bolt face scraper surface extending from a terminus of the first gas ring scraper surface, and a first bolt cylinder scraper surface extending from a terminus of the first bolt face scraper surface. Opposing positioned are a second gas ring scraper surface, a second bolt face scraper surface extending from a terminus of the second gas ring scraper surface, and a second bolt cylinder scraper surface extending from a terminus of the second bolt face scraper surface. The first gas ring scraper surface and the second gas ring scraper surface are spaced apart from each other at a distance that is less than a diameter of a cylindrical gas sealing ring holding section of the firearm bolt.

However, these patents fail to describe a compact dovetail pistol sight adjustment tool which is easy to use. Further, these patents fail to provide for a compact dovetail pistol sight adjustment tool which allows user to safely and quickly provide maintenance to a pistol.

SUMMARY OF THE INVENTION

A compact dovetail pistol sight adjustment tool is provided. The compact dovetail pistol sight adjustment tool has a main housing, a folding leg, a folding sight pusher, an adjustable ratchet and a hex drive. The compact dovetail pistol sight adjustment tool can be transformed into a collapsed orientation for easy storage and transportation.

An advantage of the present compact dovetail pistol sight adjustment tool is that the present tool is compact.

And another advantage of the present compact dovetail pistol sight adjustment tool is that the present tool is durable.

Yet another advantage of the present compact dovetail pistol sight adjustment tool is that the present tool may be used with various different pistols.

Still another advantage of the present compact dovetail pistol sight adjustment tool is that the present tool may allow for precise movement of a dovetail.

Yet another advantage of the present compact dovetail pistol sight adjustment tool is that the present tool may allow a user to adjust a dovetail pistol sight without damaging the pistol.

For a more complete understanding of the above listed features and advantages of the compact dovetail sight adjustment tool reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

Figure 1:
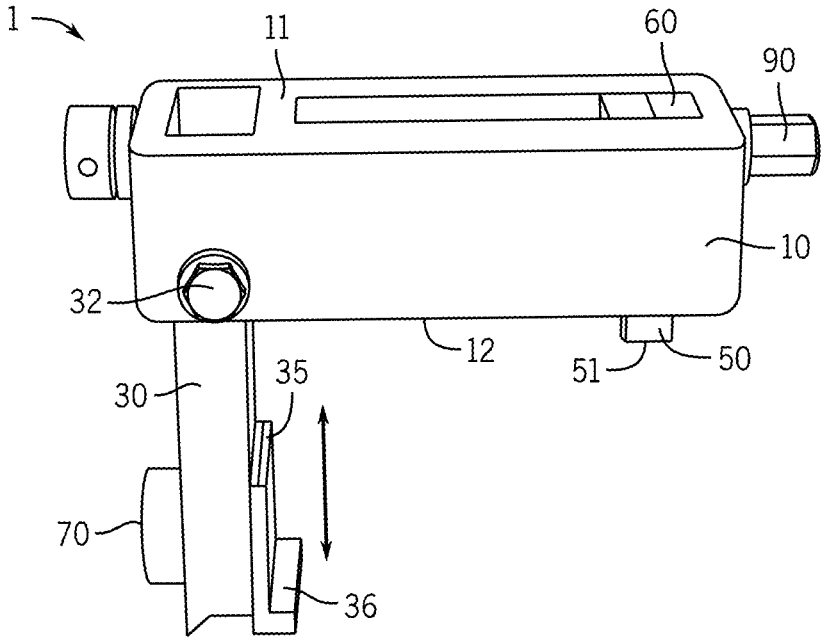
FIG. 1 illustrates a side perspective view of the compact dovetail sight adjustment tool in the first orientation.
Figure 2:
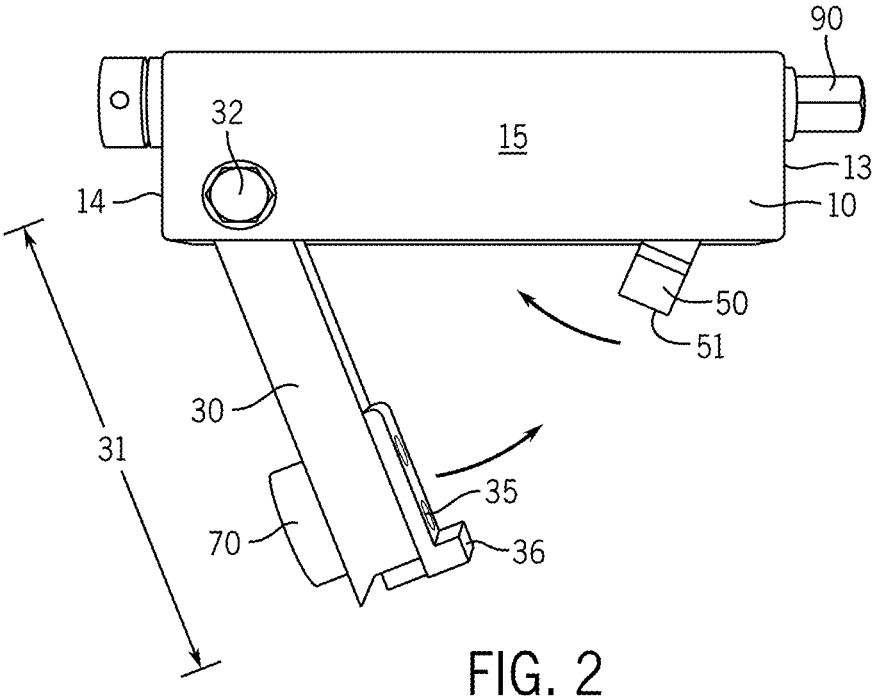
FIG. 2 illustrates a side view of the compact dovetail sight adjustment tool transitioning between the first orientation and a second orientation.

A compact dovetail pistol sight adjustment tool is provided. The compact dovetail pistol sight adjustment tool has a main housing, a folding leg, a folding sight pusher, an adjustable ratchet and a hex drive. The compact dovetail pistol sight adjustment tool can be transformed into a collapsed orientation for easy storage and transportation.

Referring now to the figures, in an embodiment, a compact dovetail pistol sight adjustment tool 1 is provided. The adjustment tool 1 is preferably made of a durable material such as plastic and or metal. In an embodiment, the adjustment tool 1 has a main body housing 10, a folding leg 30, a folding sight pusher 50, an adjustable ratchet 70 and a hex drive 90 or other suitable rotating mechanism or knob. The adjustment tool 1 is designed to be used in connection with a firearm 100; preferably a pistol.

Figure 3:
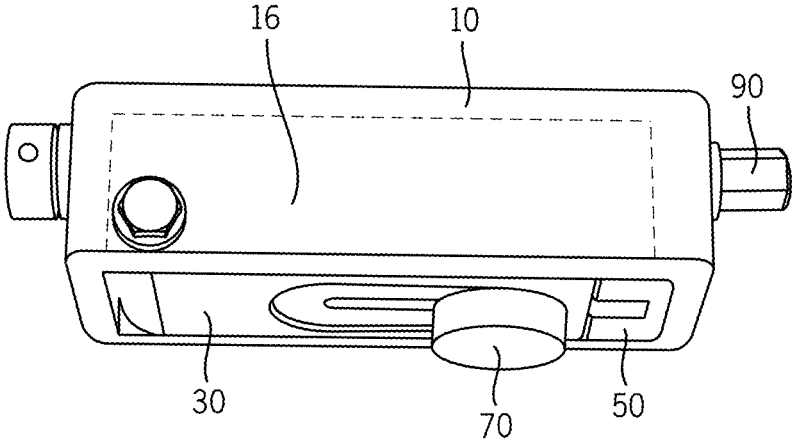
FIG. 3 illustrates a perspective side view of the compact dovetail sight adjustment tool in the second orientation.

The adjustment tool 1 may move between a usable first orientation (shown in FIG. 1) and a second orientation (shown in FIG. 3). In the first orientation of FIG. 1 the adjustment tool 1 may be used to either adjust a dovetail sight 120 of the firearm 100 by moving the dovetail sight 120 from a first position to a second position with respect to the stationary firearm 100 or may completely remove the dovetail sight 120 from the firearm 100. In the compact second orientation of FIG. 3 the adjustment tool 1 is compact and easily transported and stored.

The main body housing 10 may have a top 11, a bottom 12, a first side 13, a second side 14, a front 15, a back (not shown) and a generally open interior 16. The bottom 12 of the main body housing 10 may be open, exposing the interior 16. Located at or near the second side 14 of the main body housing 10 may be the folding leg 30. The folding leg 30 may have a length 31 which is less than the length of the main body housing 10. A pivot pin 32 may connect the folding leg 30 to the main body housing 10 so that the folding leg 30 may move between a generally perpendicular orientation with respect to the top 11 of the main body housing 10 (as shown in FIG. 1) to a folded orientation (shown in FIG. 3). In the folded orientation, the folding leg 30 is folded up into the interior 16 of the main body housing 10. The inner surface of the folding leg 30 may contact the side of the firearm 100 and may prevent the firearm 100 from moving with the dovetail sight 120 is adjusted.

Figure 4:
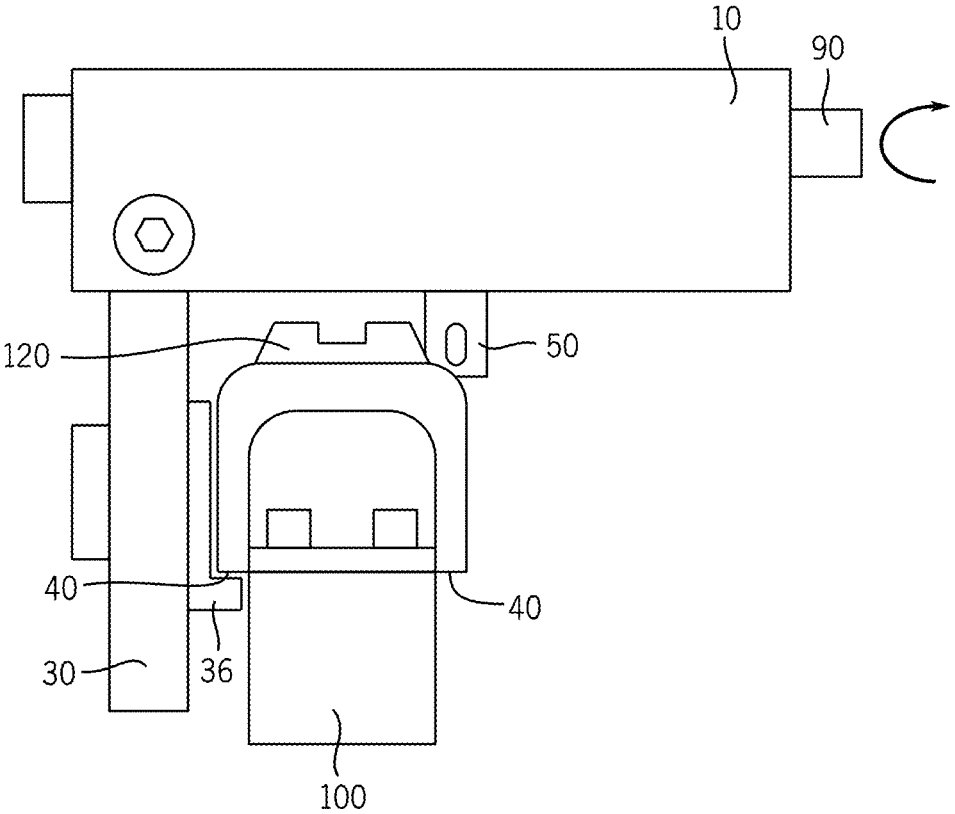
FIG. 4 illustrates a side view of the compact dovetail sight adjustment tool being used on a pistol.

Located on the distal end of the folding leg 30 (opposite the pivot pin 32) is an adjustable height mechanism 35 having an extended edge 36. The extended edge 36 of the adjustable height mechanism 35 may be used to grasp and secure the underside 40 of the main body of the firearm 100 during use of the device 1; as shown in FIG. 4. More specifically, the firearm 100 is placed under the bottom 12 of the main body housing 10 and the adjustable height mechanism 35 is then adjusted so that the extended edge 36 of the adjustable height mechanism 35 grasps the underside 40 of the main body of the firearm 100 and secures the firearm 100 to the adjustment tool 1 and prevents the firearm 100 from moving while sight pusher 50 contacts the firearm 100 and moves the dovetail 120 of the firearm 100. The extended edge 36 is adjustable by the upward or downward movement of the adjustable ratchet 70. The folding leg 30 therefore keeps the firearm 100 stationary as the dovetail sight 120 of the firearm 100 is adjusted.

As stated above, in an embodiment the adjustment tool 1 has a folding sight pusher 50. The folding sight pusher 50 has a first end 60 generally located within the interior 16 of the main body housing 10 and a second end 51. The folding sight pusher 50 moves from a first orientation of FIG. 1 wherein the folding sight pusher 50 is in a perpendicular orientation with respect to the top 11 of the main body housing 10 to a second orientation (as shown in FIG. 3) wherein the folding sight pusher 50 is located within the interior 16 of the main body housing 10. The folding sight pusher 50 pivots at a pivot pin or hinge (not shown) located within the interior 16 of the main body housing 10.

The folding sight pusher 50 may be the portion of the adjustment tool 1 that actually moves the dovetail sight 120 of the firearm 100. More specifically, once the firearm 100 is secured to the main body housing 10 by the folding leg 50 and the adjustment height mechanism 35, the folding sight pusher 50 may actually physically move the dovetail sight 120 of the firearm 100 by turning the hex drive 90. As the hex drive 90 is rotated clockwise or counter-clockwise, the hex drive 90 forces the sight pusher 50 toward the second side 14 of the device 1. As the sight pusher 50 moves toward the second side 14 of the device 1, the sigh pusher 50 physically contacts and acts upon the dovetail sight 120 and slides the dovetail sight 120 on the top of the firearm 100 as the remainder of the firearm 100 remains stationary. Accordingly, a user may therein adjust the dovetail sight 120 with respect to the firearm 100. As shown between FIGS. 1 and 4, the folding sight pusher 50 also moves horizontally with respect to the main body housing 10 in addition to folding up into the main body housing 10 for storage as shown in FIG. 3.

Because the folding sight pusher 50 can only push (and not pull) the dovetail sight 120, a user simply would attach the folding leg 30 of the adjustment tool 1 on either the right side or the left side of the firearm 100, depending on which direction the dovetail sight 120 needs to be moved.

Once the adjustment tool 1 is used to adjust the dovetail sight 120 of the firearm 100, the adjustment tool 1 may be folded into the compact orientation of FIG. 3 and easily transported in, for example, a pocket or stored.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A compact dovetail firearm sight adjustment tool comprising:

a main housing having a top, a bottom, a first side, a second side, a front and a back;

a folding leg pivotally attached to the second side of the main housing;

a movable sight pusher; and wherein the sight pusher pushes a dovetail sight of a firearm from a first position to a second position with respect to the stationary firearm.

2. The compact dovetail firearm sight adjustment tool of claim 1 further comprising:

a rotating mechanism attached to the main housing wherein the rotating mechanism moves the sight pusher when rotated.

3. The compact dovetail firearm sight adjustment tool of claim 2 wherein the rotating mechanism is a hex drive.

4. The compact dovetail firearm sight adjustment tool of claim 1 further comprising:

an interior cavity of the main housing wherein the folding leg moves from a first position to a second position and wherein in the first position the folding leg is substantially located outside of the interior cavity of the main housing and wherein the folding leg is located substantially within the interior cavity of the main housing in the second position.

5. The compact dovetail firearm sight adjustment tool of claim 1 further comprising:

an extended edge located on the folding leg wherein the extended edge has a top surface and therein the top surface of the extended edge contacts and secures a portion of the firearm.

6. The compact dovetail firearm sight adjustment tool of claim 5 further comprising:

an adjustable ratchet located on the folding leg wherein the adjustable ratchet moves the extended edge of the foldable leg from a first position to a second position.

7. The compact dovetail firearm sight adjustment tool of claim 1 further comprising:

a pivot pin wherein the pivot pin connects the folding leg to the main housing and wherein the pivot pin allows the folding leg to move from a first position to a second position with respect to the main housing.

* * * * *